United States Patent [19]

Spiros

[11] 4,405,052

[45] Sep. 20, 1983

[54] SHELF SUPPORT BRACKET

[75] Inventor: Dennis J. Spiros, Punta Gorda, Fla.

[73] Assignee: Nestier Corporation, Cincinnati, Ohio

[21] Appl. No.: 189,196

[22] Filed: Sep. 22, 1980

[51] Int. Cl.[3] ..... A47F 5/00

[52] U.S. Cl. ..... 211/49 D; 211/187; 248/243

[58] Field of Search ..... 211/134, 187, 49 D, 211/151, 182, 186, 153; 248/243; 108/106, 107

[56] References Cited

U.S. PATENT DOCUMENTS

| | | | |
|---|---|---|---|
| 1,880,179 | 9/1932 | Onions | 108/107 X |
| 2,803,352 | 8/1957 | Smola et al. | 248/243 X |
| 2,905,425 | 9/1959 | Novales | 248/243 |
| 3,081,717 | 3/1963 | Yurevich | 108/107 |
| 3,900,112 | 8/1975 | Azzi et al. | 211/151 X |

FOREIGN PATENT DOCUMENTS

| | | | |
|---|---|---|---|
| 409278 | 9/1966 | Switzerland | 108/107 |

*Primary Examiner*—Ramon S. Britts
*Assistant Examiner*—Robert W. Gibson, Jr.
*Attorney, Agent, or Firm*—Thomas E. Beall, Jr.

[57] ABSTRACT

A shelf support bracket including a flat rectangular plate having opposite end edges and opposite side edges. Tabs extend outwardly from the plate in one direction for mounting same to a vertical column. Flanges extend outwardly from the side edges of the plate in a direction opposite to the tabs. The flanges have a length substantially less than the length of the side edges. The opposite ends of the flanges are provided with hooks which are spaced different distances from the plate end edges. This allows the plate to be inverted for selectively supporting a shelf on one or the other of the hooks to vary the elevation of the shelf.

19 Claims, 6 Drawing Figures

SHELF SUPPORT BRACKET

BACKGROUND OF THE INVENTION

This application relates to the art of shelf support brackets and, more particularly, to such brackets used for supporting downwardly inclined shelves in gravity flow racks used for order picking systems.

Shelf support brackets must usually be moved upwardly or downwardly to new mounting holes for changing the support elevation thereof. It would be desirable to provide a shelf support bracket which could vary its support elevation to a degree less than that obtained by moving same to a new support location.

SUMMARY OF THE INVENTION

A shelf support bracket includes a generally flat rectangular plate having opposite end edges and opposite side edges. Mounting means is provided on the plate for mounting same to a vertical column. In one arrangement, the mounting means is in the form of T-shaped tabs bent outwardly from the plate.

Flanges extend outwardly from the plate side edges generally perpendicular thereto in a direction opposite from the tabs. The flanges have a length substantially less than the length of the plate side edges. The opposite ends of the flanges are provided with hooks located at different distances from the plate end edges. This allows the plate to be inverted for supporting a shelf at different elevations on the hooks. The flanges are preferably spaced outwardly from the plate side edges.

The bracket supports a shelf defined by a generally rectangular frame having opposite side frame members, and front and rear rails. Each side frame member has two pair of arcuate notches in the bottom edge thereof. One pair of notches in the bottom edge of each side frame member is located adjacent the front rail, while the other pair of notches in the bottom edge of each side frame member is located adjacent the rear rail. One notch in each pair is located closer to the front rail than the other notch in each pair. The one notch of all the notch pairs has a depth and width substantially greater than the depth and width of the other notch. The shelf frame is supported on the brackets by having the hooks received in the arcuate notches. The arcuate shape of the notches provide self-centering, and the different depth of the notches facilitates support of the frame on the brackets in an inclined position.

It is a principal object of the present invention to provide an improved shelf support bracket.

It is also an object of the invention to provide a shelf support bracket which is capable of being inverted for supporting a shelf at two different elevations.

It is an additional object of the invention to provide an improved shelf frame having hook receiving notches in the bottom edges of the shelf side frame members.

DESCRIPTION OF A PREFERRED EMBODIMENT

Figure 1:
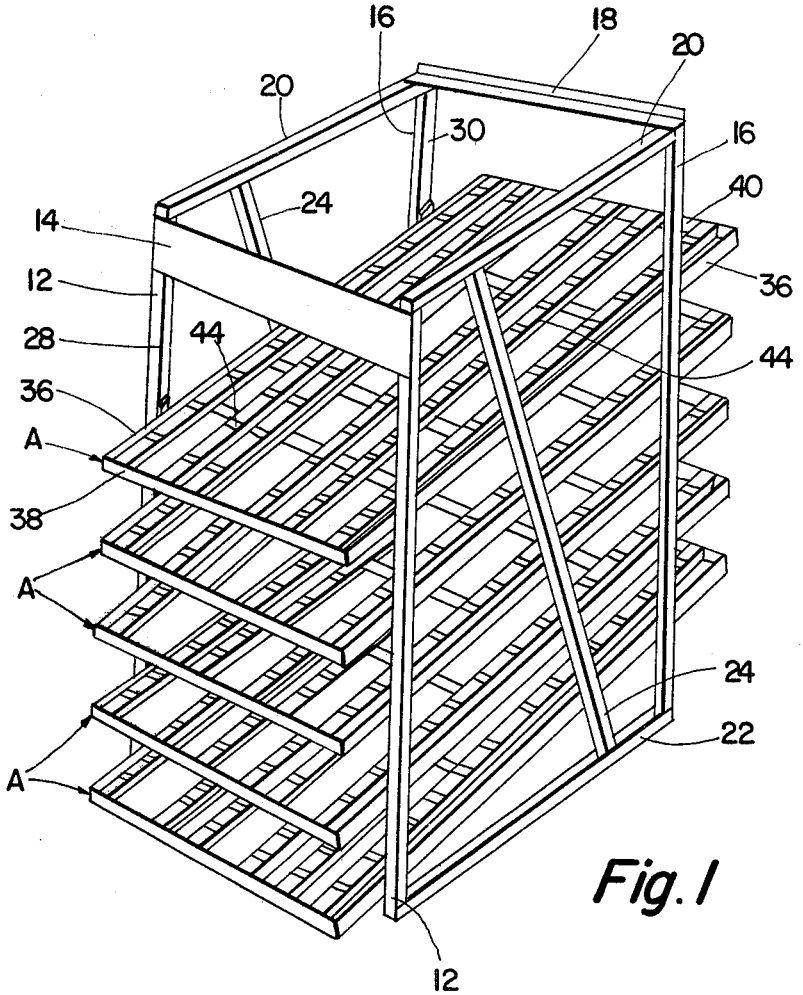
FIG. 1 is a diagrammatic perspective illustration of a gravity flow rack used in a merchandise order picking system.

With reference to the drawing, FIG. 1 shows a generally cubical skeleton support including vertical front columns 12 connected by an upper front connecting member 14. Spaced vertical rear columns 16 are connected by an upper rear connecting member 18. Upper side connecting members 20 and lower side connecting members 22 are provided for connecting front and rear columns 12, 16. Diagonal frame members 24 extend between upper and lower side connecting members 20, 22.

Front columns 12 have facing inner surfaces 28 which face toward one another, and rear columns 16 have facing inner surfaces 30 which face inwardly toward one another. Brackets are affixed to columns 12, 16 against inner surfaces 28, 30 thereof for supporting a plurality of vertically-spaced shelves A which are downwardly inclined in a direction from rear columns 16 toward front columns 12. Each shelf A is in the form of a generally rectangular frame including spaced parallel opposite side frame members 36, and spaced parallel front and rear rails 38, 40. A plurality of elongated track members 44 span front and rear rails 38, 40. Merchandise cartons are placed on track members 44 adjacent rear rail 40 and the cartons slide down the track members 44 toward front rail 38.

Figure 2:
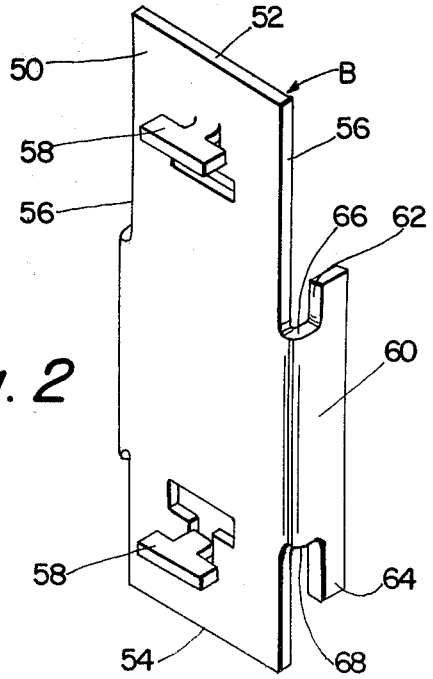
FIG. 2 is a perspective illustration of a bracket constructed in accordance with the present application.
Figure 3:
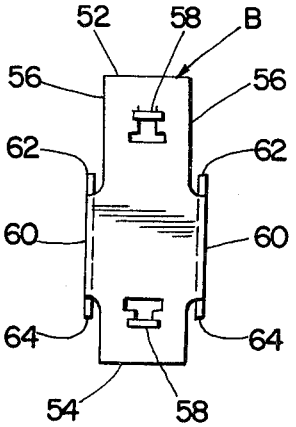
FIG. 3 is an elevational view of the bracket.

FIGS. 2 and 3 show a shelf support bracket B including a generally flat rectangular plate 50 having opposite end edges 52, 54 and opposite side edges 56.

Mounting means is provided on plate 50, and in the arrangement shown the mounting means is in the form of generally T-shaped tabs 58. Tabs 58 are T-shaped as viewed from an end edge 52 or 54 looking parallel to the plane of plate 50. Tabs 58 are punched from plate 50 to leave generally T-shaped holes therein. After bending tabs 58 outwardly generally perpendicular to plate 50, the holes are on the opposite sides of tabs 58 from end edges 52, 54.

Flanges 60 are bent outwardly from opposite side edges 56 in a direction opposite to tabs 58. Flanges 60 have a length substantially less than the length of plate side edges 56. The opposite ends of flanges 60 are provided with hooks generally indicated at 62, 64. Hooks 62, 64 have hook bottoms or saddle portions 66, 68 for supporting a shelf side frame member extending generally parallel to bracket plate 50. That is, the axes of the saddles 66, 68 extend generally parallel to plate 50. Hook 62 is spaced from plate end edge 52 a different distance than the spacing of hook 64 from plate end edge 54. More specifically, hook saddle 66 is spaced from plate end edge 52 a distance which is between 1.5 and 2 times the distance which hook saddle 68 is spaced from plate end edge 54. As shown in FIG. 3, flanges 60 are spaced outwardly from plate side edges 56. That is, the inner surfaces of flanges 60 which face toward plate side edges 56 are spaced outwardly from plate side edges 56 approximately 0.10 inch.

Figure 6:
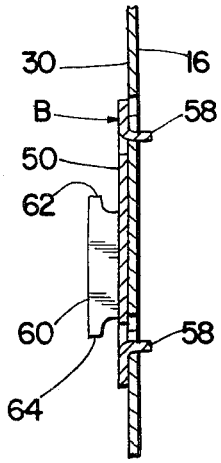
FIG. 6 is a cross-sectional elevational view taken generally on line 6—6 of FIG. 4.

The critical distances, however, are (1) the distance between hook 62 and upper T-shaped tab 58 and (2) the distance between hook 64 and lower T-shaped tab 58, upper and lower referring to the relative position of the tabs in FIGS. 2, 3 and 6. It is important that hook 62 be spaced from upper tab 58 a different distance than the spacing of hook 64 from lower tab 58. In the specific embodiment of the device shown in FIGS. 2, 3 and 6, the distance of hooks 62 and 64 from their respective end edges 52 and 54, as described in the preceding paragraph, accomplish the same result. But in this specific case, the distances from upper tab 58 to end edge 52 and lower tab 58 to end edge 54 are equal. If these distances were not equal, the important relationship becomes that between the hooks 62 and 64 and the tabs 58, not between the hooks and the end edges.

Columns 12, 16 are tubular and of generally square cross-sectional shape. Column inner facing surfaces 28, 30 have longitudinally-spaced T-shaped holes 72 therein. Four brackets B are provided for mounting each shelf A, with one bracket being affixed to each column 12, 16. Brackets B are affixed to the columns by inserting tabs 58 into slots 72 and then lowering the brackets so that the wide portion of tabs 58 is locked behind the narrow vertical portion of slots 72. Brackets B are positioned with flanges 60 extending outwardly away from facing inner surfaces 28, 30 of columns 12, 16.

Figure 4:
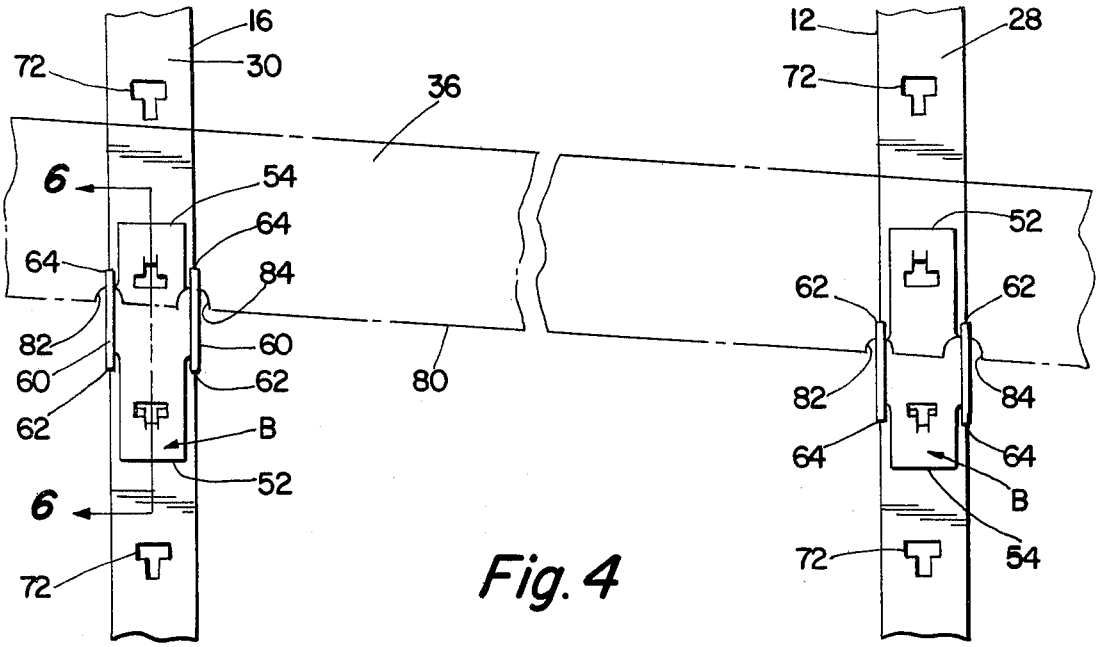
FIG. 4 is a side elevational view showing vertical columns having the bracket of FIGS. 2 and 3 affixed thereto, and with a shelf side frame member supported thereon.
Figure 5:
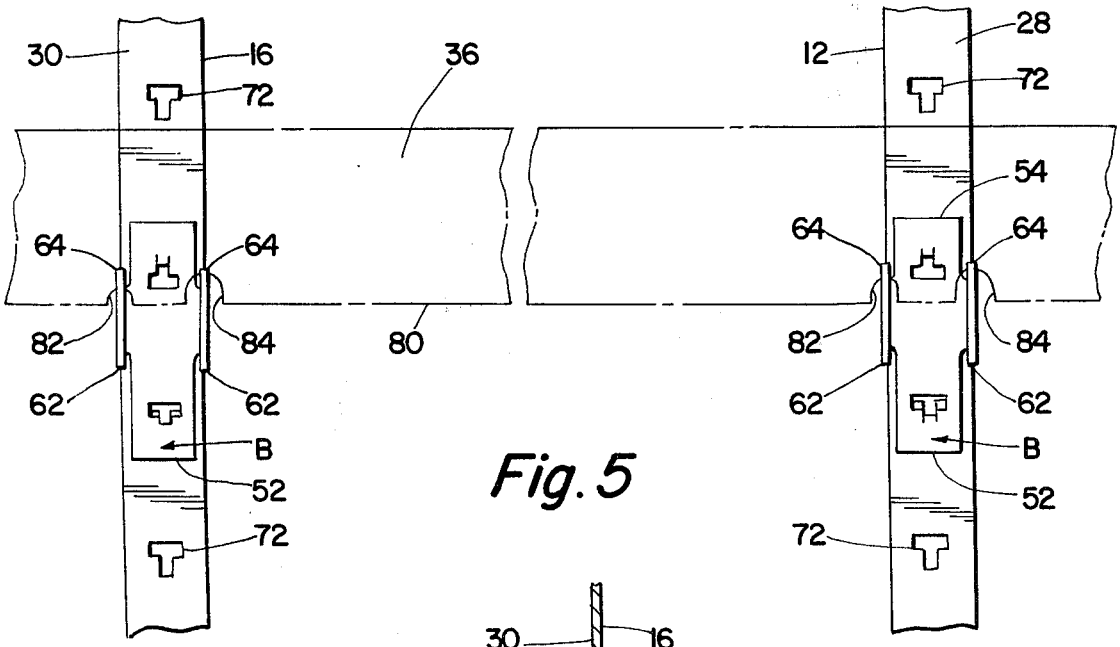
FIG. 5 is a view similar to FIG. 4 showing one bracket inverted from the position of FIG. 4.

FIGS. 4 and 5 show a shelf side frame member 36 having a bottom edge 80 in which two pair of arcuate notches are formed. Each pair of notches includes a small arcuate notch 82 and a large arcuate notch 84 having a depth and width substantially greater than notch 82. Notches 82, 84 in each pair of notches are spaced from one another approximately the same distance as the spacing between flanges 60 on a support bracket B. One pair of notches 82, 84 in bottom edge 80 of each side frame member 36 is located adjacent front rail 38, while the other pair of notches in bottom edge 80 for the same side frame member 36 are located adjacent rear rail 40. The one notch 84 of each notch pair which is located closer to front rail 38 has a depth and width substantially greater than the other notch 82 of each notch pair.

Mounting tabs 58 are at the same distance from plate edges 52, 54. FIG. 4 shows brackets B mounted in holes 72 located at the same elevation for both columns 12 and 16. However, bracket B on column 12 is inverted relative to the bracket mounted on column 16. This means that hooks 62 will support shelf side frame member 36 at a lower elevation than the support provided for such frame member by hooks 64 of the bracket on column 16. Thus, shelf frame member 36 is downwardly inclined in a direction from rear column 16 toward front column 12. The arcuate shape of notches 82, 84 provides self-centering of the frame members on the hook saddles for different inclinations of the side frame members. The arrangement described makes it possible to provide an intermediate adjustment which is less than a total adjustment provided by completely moving a bracket to a new set of holes 72. For example, if the bracket on column 12 were moved down to the next lower set of holes 72, the downward inclination of side frame member 36 would be much steeper. By providing the different spacing of the hooks and the invertibility of the brackets, an intermediate slope is provided having a lower slope angle than would be provided by completely moving a bracket to a new set of column holes.

FIG. 5 simply shows a shelf supported in a horizontal position on brackets B located at the same elevation and with the same hooks facing upwardly.

Although the invention has been shown and described with respect to a preferred embodiment, it is obvious that equivalent alterations and modifications will occur to others skilled in the art upon the reading and understanding of this specification. The present invention includes all such equivalent alterations and modifications, and is limited only by the scope of the claims.

I claim:

1. A bracket for supporting shelves on vertical columns, said columns having at least one vertical row of mounting holes; a substantially flat and generally rectangular plate having opposite end edges and opposite side edges, first and second vertically spaced mounting means on said plate for mounting said plate to respective first and second ones of said mounting holes, at least one integral flange for engaging said shelves bent from one of said side edges and extending generally perpendicular to said plate, said flange having opposite flange end portions provided with opposite first and second hooks opening outwardly toward said opposite end edges respectively, said first hook being spaced a first certain distance from said first mounting means, said second hook being spaced a second certain distance from said second mounting means, said first and second distances being of different length so that said plate may be mounted with said first and second mounting means respectively engaging said first and second holes for supporting a shelf on said one hook and may be mounted inverted with said first and second mounting means respectively engaging said second and first holes for supporting the shelf on said second hook to thereby change the elevation of said shelf.

2. The bracket of claim 1, wherein said mounting means and said holes are vertically aligned.

3. The bracket of claim 1, wherein each plate includes two of said integral flanges, respectively bent from said two side edges, and each said flange has said opposite flange end portions so as to provide a first pair of horizontally spaced and horizontally aligned hooks and vertically spaced therefrom a second pair of horizontally aligned and horizontally spaced hooks.

4. The bracket of claim 3, wherein the hooks of one flange are vertically aligned, the hooks of the other flange are vertically aligned and the mounting means are vertically aligned midway between said flanges.

5. A rack comprising of a plurality of brackets as defined in claim 1, and further including a skeleton support having a pair of horizontally spaced apart front columns having facing inner surfaces with a plurality of vertically aligned mounting holes and a pair of horizontally spaced apart rear columns having facing inner surfaces with a plurality of vertically aligned mounting holes, said brackets being attached to said columns against said inner surfaces with said mounting means in said holes, respectively, a shelf including a generally rectangular frame having opposite side frame members and front and rear rails, said shelf being positioned between said columns with said side frame members supported on said brackets, said brackets being attached to said columns with said flanges extending away from said inner faces, and said side frame members having bottom edges supported on said hooks.

6. The rack of claim 5, wherein for each bracket said mounting means and said holes are vertically aligned.

7. The rack of claim 5, wherein for each bracket each plate includes two of said integral flanges, respectively bent from said two side edges, and each said flange has said opposite flange end portions so as to provide a first pair of horizontally spaced and horizontally aligned hooks and vertically spaced therefrom a second pair of horizontally aligned and horizontally spaced hooks.

8. The rack of claim 7, wherein for each bracket the hooks of one flange are vertically aligned, the hooks of the other flange are vertically aligned and the mounting means are vertically aligned midway between said flanges.

9. The bracket of claim 1 wherein said mounting means comprises tabs bent outwardly from said plate in a direction opposite to said flanges.

10. The bracket of claim 2 wherein said tabs are generally T-shaped.

11. The bracket of claim 1 wherein said hooks have hook bottoms and one said hook bottom is spaced from one said plate end edge a distance between 1.5 and 2 times the spacing of the other hook bottom from the other plate end edge.

12. The bracket of claim 1 wherein said flanges are spaced outwardly beyond said plate side edges.

13. The rack of claim 5 wherein said mounting means comprises tabs bent from said plate in a direction opposite to said flanges and said inner surfaces of said columns have holes therein receiving said tabs.

14. The rack of claim 13 wherein said tabs and holes are generally T-shaped.

15. The rack of claim 5 wherein said flanges are spaced outwardly beyond said plate side edges.

16. A shelf for a gravity flow rack order picking system comprising: a generally rectangular frame having opposite side frame members and front and rear rails, said side frame members having bottom edges, each said bottom edge having two pair of spaced arcuate notches therein, one said pair of notches in each said bottom edge being adjacent said front rail and the other pair of notches in each said bottom edge being adjacent said rear rail, one notch in each said pair of notches being closer to said front rail than the other notch in each notch pair, and said one notch in all of said notch pairs being of a substantially greater depth than said other notch.

17. The shelf of claim 6 wherein said one notch has a substantially greater width than said other notch.

18. A rack comprising: a skeleton support including a pair of spaced front columns having facing inner surfaces, and a pair of spaced rear columns having facing inner surfaces, support brackets attached to said columns against said inner surfaces, a shelf including a generally rectangular frame having opposite side frame members and front and rear rails, said shelf being positioned between said columns with said side frame members supported on said brackets, each said bracket comprising a substantially flat and generally rectangular plate having opposite end edges and opposite side edges, mounting means on said plate for mounting same to said columns, integral flanges bent from said side edges and extending generally perpendicular to said plate, said flanges having a length substantially less than the length of said side edges, said flanges having opposite flange end portions provided with opposite hooks opening outwardly toward opposite end edges, said hooks being spaced different distances from said end edges whereby said plate may be inverted for supporting a shelf on one or the other of said hooks to thereby change the elevation of the shelf, said brackets being attached to said columns with said flanges extending away from said inner faces, said side frame members having bottom edges supported on said hooks, and said brackets being invertable for selectively supporting said bottom edges on one or another of said hooks for varying the elevation of said shelf, said bottom edge of each said side frame member having two pair of arcuate notches therein, one pair of said notches in each said bottom edge being adjacent to said front rail and the other pair of notches in each said bottom edge being adjacent to said rear rail, one notch of each said pair of notches being closer to said front rail than the other notch in each said pair of notches, and said one notch in all of said pairs of notches being of a substantially greater depth than said other notch in all of said pairs of notches.

19. The rack of claim 18 wherein said one notch has a substantially greater width than said other notch.

* * * * *